US011305542B2

(12) United States Patent
Qian et al.

(10) Patent No.: US 11,305,542 B2
(45) Date of Patent: Apr. 19, 2022

(54) PRINT HEAD SERVICING

(71) Applicant: HEWLETT-PACKARD DEVELOPMENT COMPANY, L.P., Spring, TX (US)

(72) Inventors: Li Qian, Sant Cugat del Valles (ES); Francisco Guerrero Carvajal, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/498,641

(22) PCT Filed: May 15, 2018

(86) PCT No.: PCT/US2018/032802
§ 371 (c)(1),
(2) Date: Sep. 27, 2019

(87) PCT Pub. No.: WO2019/221714
PCT Pub. Date: Nov. 21, 2019

(65) Prior Publication Data

US 2021/0331480 A1 Oct. 28, 2021

(51) Int. Cl.
*B41J 2/165* (2006.01)

(52) U.S. Cl.
CPC ..... *B41J 2/16535* (2013.01); *B41J 2/16552* (2013.01); *B41J 2002/16558* (2013.01)

(58) Field of Classification Search
CPC ..... B41J 2002/16558; B41J 2/16535; B41J 2/16552
See application file for complete search history.

(56) References Cited

U.S. PATENT DOCUMENTS

| | | | | |
|---|---|---|---|---|
| 5,414,454 | A | 5/1995 | Reid | |
| 6,913,338 | B2 | 7/2005 | Rhoads et al. | |
| 7,770,518 | B2 | 8/2010 | Barinaga et al. | |
| 7,824,006 | B2 | 11/2010 | Park | |
| 8,002,382 | B2 | 8/2011 | Steinfield et al. | |
| 8,905,516 | B2 | 12/2014 | Inoue | |
| 9,452,607 | B2 | 9/2016 | Kuypers et al. | |
| 2005/0156995 | A1 | 7/2005 | Nishino | |
| 2010/0315463 | A1 | 12/2010 | Escude et al. | |
| 2012/0236071 | A1 | 9/2012 | Inoue | |
| 2013/0120496 | A1 | 5/2013 | Nakamura et al. | |
| 2013/0176362 | A1* | 7/2013 | Inoue | B41J 2/16552 347/33 |
| 2015/0109367 | A1 | 4/2015 | Cerro et al. | |
| 2017/0085750 | A1* | 3/2017 | Katsuyama | H04N 1/52 |

(Continued)

FOREIGN PATENT DOCUMENTS

| | | | |
|---|---|---|---|
| CN | 101890840 | A | 11/2010 |
| CN | 103921557 | A | 7/2014 |

(Continued)

*Primary Examiner* — Jason S Uhlenhake

(74) *Attorney, Agent, or Firm* — HP Inc. Patent Department

(57) ABSTRACT

A method comprising: soaking a portion of a web in a printing device with printing liquid from a first print head (110) of the printing device; and wiping at least one nozzle of a second print head (120) in the printing device with the soaked portion of the web. The method provides a servicing method for print heads in the printing device.

15 Claims, 9 Drawing Sheets

(56) References Cited

U.S. PATENT DOCUMENTS

| | | | |
|---|---|---|---|
| 2018/0079217 A1 | 3/2018 | Hiratsuka et al. | |
| 2018/0207936 A1* | 7/2018 | Satake | B41J 2/16538 |

FOREIGN PATENT DOCUMENTS

| | | |
|---|---|---|
| EP | 988148 | 3/2000 |
| JP | 2017043005 A | 3/2017 |
| WO | WO-2006111707 | 10/2006 |
| WO | WO-2007112337 | 10/2007 |
| WO | WO-2017072134 A1 | 5/2017 |
| WO | WO-2018021997 | 2/2018 |

* cited by examiner

PRINT HEAD SERVICING

BACKGROUND

There are several servicing routines for a print head, including spitting, wiping and priming. Priming is often used when spitting fails for effective servicing of nozzles on the print head. Spitting can include forcing a print head to fire an amount of printing liquid through the nozzles of the print head to clear them by using an ejection mechanism for the nozzles. Wiping can include using a wiping blade to wipe a web against the nozzles. Priming can include inflating a variable volume air chamber inside the print head to open a supply of printing liquid, and thereby force printing liquid out of the nozzles. However, if the primer system fails then one or more nozzles on the print head can become permanently clogged. In certain cases, priming has to be done before spitting to be able to prevent permanently clogging the nozzles.

DETAILED DESCRIPTION

Figure 1:
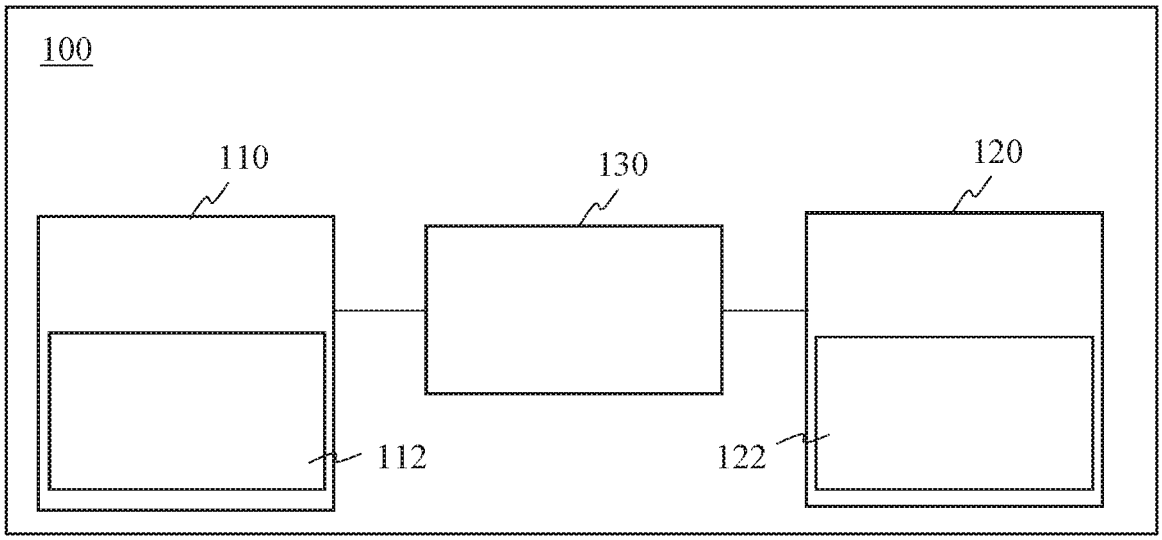
FIG. 1 is a schematic diagram showing an example of an apparatus for a printing device.

Referring to FIG. 1, an example apparatus 100 for a printing device is shown. The apparatus 100 comprises a first print head 110 and a second print head 120. The first print head 110 comprises a first set of nozzles 112 from which printing liquid from the first print head 110 is ejected. The second print head 120 comprises a second set of nozzles 122, from which printing liquid from the second print head 120 is ejected. The apparatus 100 further comprises a controller 130, which controls the movement and functions of the first print head 110 and the second print head 120. If the nozzles of the second print head are clogged or otherwise not able to let through printing liquid, the first print head can be used to clear the nozzles. The controller can move the first print head to a position in which the first set of nozzles are near or in contact with a web that is used to service the nozzles. The first print head and the first set of nozzles are subsequently controlled by the controller to wet a region of the web in printing liquid. The controller then positions the second print head with respect to the web so as to wet the second set of nozzles with the wetted region of the web. By wetting the second set of nozzles, the nozzles may clear. The printing liquid may be ink or another suitable printing fluid.

Figure 2:
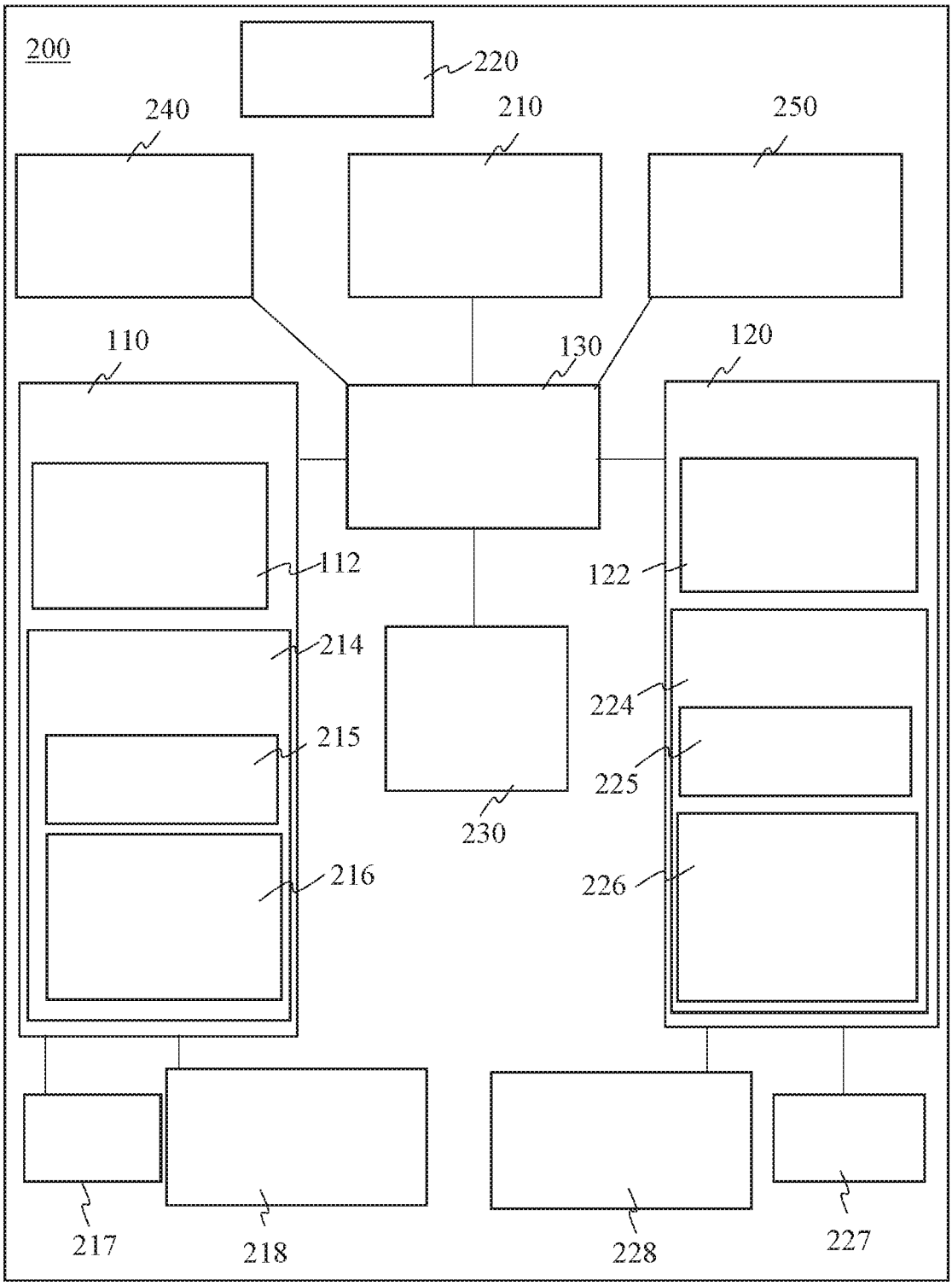
FIG. 2 is a schematic diagram illustrating an example of a printing device.

FIG. 2 is a schematic diagram illustrating a printing device 200. The printing device can comprise a 2D or 3D printing device, copier or multi-functional device. The printing device 200 comprises the apparatus 100 of FIG. 1. The printing device also comprises further apparatus for printing and/or servicing the print heads. The printing device comprises a first printing liquid chamber 214 in the first print head and a second printing liquid chamber 224 in the second print head, being the first and second printing liquid chambers 214, 224 provided to contain printing liquids. During printing mode, the controller can then control the first print head to eject first printing liquid 215 from the first print head and/or eject second printing liquid 225 from the second print head in order to print on a print target (not shown in FIG. 2). The printing device may comprise a carriage 210 which movably supports the first print head 110 and the second print head 120. The carriage may be movably mounted on guide rails (not shown in FIG. 2) and is transported along the guide rails using for example an arrangement comprising a belt, pulley and a motor (not shown in FIG. 2).

The printing device 200 also comprises a plurality of servicing components, forming part of a servicing station, comprising a web 220 to be used during nozzle servicing. The web 220 may be a consumable component which comprises a length of material on which printing liquid can be ejected and absorbed. The print heads may be moved from a printing position, where they are located during printing mode, to a service position near the servicing components, to allow servicing of the print heads. The carriage 210 can be controlled to move the first print head into a servicing position in which it soaks the web 220 in printing liquid. The carriage can then be controlled to move the second print head into a servicing position in which the second set of nozzles are near or in contact with the soaked region of the web. A nozzle plate of the second print head 120 comprising the second set of nozzles 122 can then be soaked and wiped on the web in order to unclog the nozzles. For example, the controller can move the carriage to move the second print head in a direction along the soaked region of the web to wipe the second set of nozzles along the soaked region of the web. The printing device 200 may also comprise a wiping blade 230 as part of the servicing components. The wiping blade 230 engages with the web 220 to push the web into contact with the nozzles of the first print head 110 or the second print head 120. The wiping blade 230 is located on the opposite side of the web 220 to the first print head 110 and/or the second print head 120 when the print heads are in the servicing position. The wiping blade may be formed of an elastomeric material such as a vinyl. It may be movably mounted such that it can be moved, from a first position away from the web, to a second position in which it engages the web. In some examples, it may also be movable to a third position in which it presses the web into the nozzles. In some examples, it may be mounted on a separate carriage (not shown in FIG. 2) that can move the blade in a direction along the soaked region of the web to ensure that the soaked region of the web touches the nozzles of the second print head. The soaked area of the web may be wider than the nozzle plate and by moving the blade it can allow the soaked web to touch each of the nozzles of the second print head. Moving the print head or blade along the soaked region of the web can include moving the print head or blade along or across the web or in any other direction in a plane parallel or substantially parallel to the web. Although a carriage for moving the print heads have been described with respect to FIG. 2, in some examples, the print heads may not be supported on a movably carriage. The printing device may for example be a page-wide printing device wherein the print heads are provided in a fixed page-wide array and the servicing station is provided in a movable carriage such that the servicing station can be moved to service the print head.

By using the soaked region to wet and further wipe the nozzles of the second print head, dried printing liquid or other particles dogging the nozzle chambers can be removed. By using printing liquid from a working print head to unclog the nozzles, an existing print head can be used to provide liquid, in this case printing liquid, to clear the nozzles of another print head. Moreover, by using the method described herein of wetting nozzles using printing liquid from a working print head, the nozzles can be serviced in situ in the printing device and no components have to be removed for servicing, providing a robust and reliable servicing method.

The printing device may also comprise a first primer and a second primer arrangements respectively comprising first and second variable volume air chambers 216, 226, first and second pumps 217, 227 and first and second primer processing circuitry 218, 228, as will be described in more detail below with respect to FIG. 3*b*. The printing device may also comprise a drop detector 240 to be used by the controller to determine the printing condition of each print head. The drop detector comprises a sensor to detect malfunctioning nozzles, e.g., clogged nozzles from which printing liquid is not ejected. The drop detector may comprise any sensor, such as an optical sensor, which is able to detect the ejection of a drop of liquid. The drop detector may be located in the servicing station. The printing condition may for example be a value indicating the number or percentage of nozzles on the print head that are able to eject printing liquid. However, the printing condition may be determined in any suitable way. The printing device further comprises a memory 250 to store instructions and data used by the controller 130 to control components of the printing device 200.

The printing device will also comprise additional components not shown in FIG. 2 for controlling the printing device to print on print targets, such as, but not limited to, additional components of the print heads, such as heating elements, arrangements for moving the print target and interfaces for interfacing with computing devices and users. During the printing process, the carriage is used to move the print head containing the set of nozzles to a print position over a print target such as a sheet of paper. A current is passed through a heating element in the print head to vaporize the printing liquid and force a droplet of printing liquid through a nozzle and onto the print target. The controller, or a separate printing controller, may receive instructions from a computing device and determines which nozzles should be activated to print the desired output. When the printing process has ended, or if there is a fault, the carriage may transport the print heads from the printing position into the servicing position.

Figure 3A:
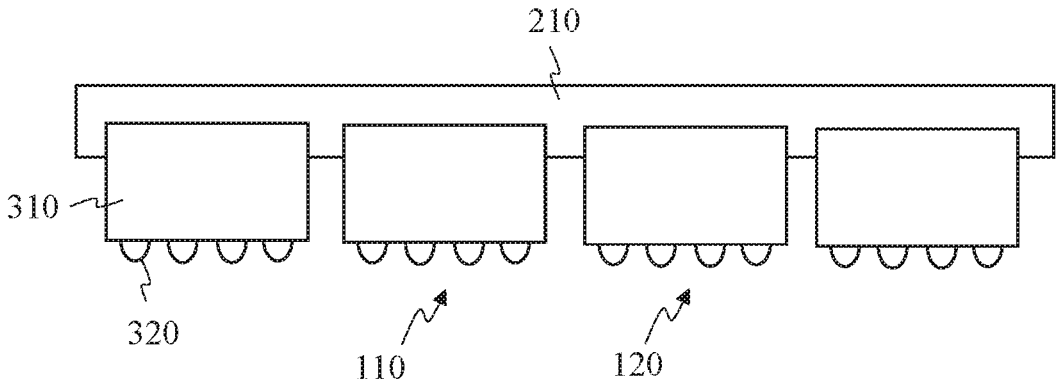
FIGS. 3*a* and 3*b* show examples of arrangements of some of the components of the printing device in more detail.

FIG. 3*a* shows an example view of the carriage 210 comprising a plurality of print heads 310 including the first print head 110 and the second print head 120. In the specific example of FIG. 3*a*, there are four print heads 310. Any of the print heads can form the first or second print head depending on which print heads are working and which print heads have failed. Each print head comprises a nozzle plate comprising nozzles 320. For example, in a specific example each print head may comprise 10560 nozzles providing printing liquid of 10 different colors. In some examples, the controller can control the carriage to move the print heads to wipe the print heads horizontally across all the colors with the web. Although FIG. 3*a* shows a carriage carrying four print heads, this is just one example and the printing device can comprise any suitable number of print heads. Moreover, although each print head has been described to comprise 10560 number of nozzles providing printing liquid of 10 different colors, this is just one example and the print heads can comprise any suitable number of nozzles providing printing liquid of any suitable number of colors. Although one printing liquid chamber is shown FIG. 3*b*, a separate printing liquid chamber may be provided for each printing liquid color used. In some examples, the print heads may not all be carried by the same carriage. Some printing devices may comprise more than one carriage and each carriage may carry one or more of the print heads in the printing device.

As mentioned above, during normal printing operation, the print head ejects printing liquid using the nozzles to print on a print target. The printing liquid may dry inside the nozzle chambers, causing the nozzles to become dogged. The term dogged, as used herein, can be understood to mean partially dogged or blocked as appropriate. Particles from the liquid, dust particles or paper fibers may also contribute to clogging. Clogging of the nozzles is particularly present for example during breaks in the printing process, when the liquid has time to dry. Long breaks, such as capped overnight storage, exasperates the presence of dogged nozzles. The controller may then start one or more servicing operations to unclog the nozzles.

An example of a servicing operation may include spitting, during which the controller forces a print head to fire an amount of printing liquid through the nozzles to clear them by using an ejection mechanism for the nozzles, e.g., a thermal and/or a piezoelectric-based fluid ejection. In another example, the controller may prime the nozzles, as has been mentioned above. With reference to FIG. 3*b*, showing an enlarged version of the first print head of FIG. 3*a*, during priming, printing liquid is forced out of the nozzles by increasing the pressure in the printing liquid chamber 215 in the print head. Inside the printing liquid chamber 214 is the variable volume air chamber 216 which can change in size using the external pump 217. During priming, the pump 217 pumps air into the variable volume air chamber 216 to increase the volume of the variable volume air chamber 216. The expanding variable volume air chamber 216 moves a lever 320 to open a valve at a printing liquid inlet 330 connecting the printing liquid chamber 214 and a tube to the printing liquid supply in the printing device. Printing liquid from the printing liquid inlet 330 enters the printing liquid chamber 214 and is forced out of the nozzles 112. The controller controls the priming via the prime processing circuitry 218. The processing circuitry may also be used to detect a failure or success of the prime using a current monitor 340, as will be described in more detail with respect to FIG. 5. If priming fails for some print heads, the controller may then proceed to the method of servicing the print heads described herein comprising wiping nozzles with web soaked in printing liquid from a working print head. In other words, in some examples, a primer failure associated with a print head is detected before the controller carries out the wiping of the nozzles of the print head with printing liquid soaked web. Alternatively, in some examples, the controller may not attempt a prime but may proceed directly to the servicing method described herein, including soaking nozzles with printing liquid from a working print head. The servicing method including soaking nozzles with printing liquid from a working print head can be used as an alternative to priming or spitting.

Figure 4:
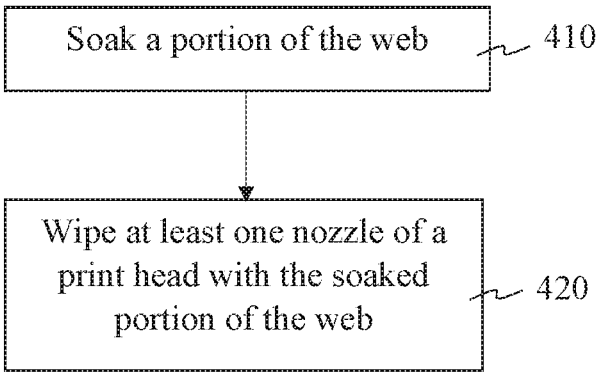
FIG. 4 shows an example flowchart of an operating method for servicing a print head.

FIG. 4 is an example flowchart of an operating method for servicing a print head. Printing liquid from a print head, corresponding to the first print head, is used to soak a portion of the web 220 at 410. In more detail, the first print head 110 may eject printing liquid 115 through the first set of nozzles 112 onto a portion of the web 220 by priming or spitting the printing liquid onto the portion of the web 220. The controller 130 may position the carriage 210 such that the printing liquid 115 of the first print head 110 is ejected onto the web 220 when the first print head 110 performs a fluid ejection, for example through a spitting or priming operation. At least one nozzle of another print head, corresponding to the second print head, is wiped with the soaked portion of the web 220 at 420. In more detail, the controller 130 may position the second print head 120 such that at least one nozzle of the second set of nozzles 122 of the second print head 120 is ready to be contacted by the soaked portion of the web 220. The soaked portion of the web 220 and the at least one nozzle of the second set of nozzles 122 of the second print head 120 are then brought into contact with one another and the at least one nozzle of the second set of nozzles is wiped with the soaked portion of the web 220.

Figure 5:
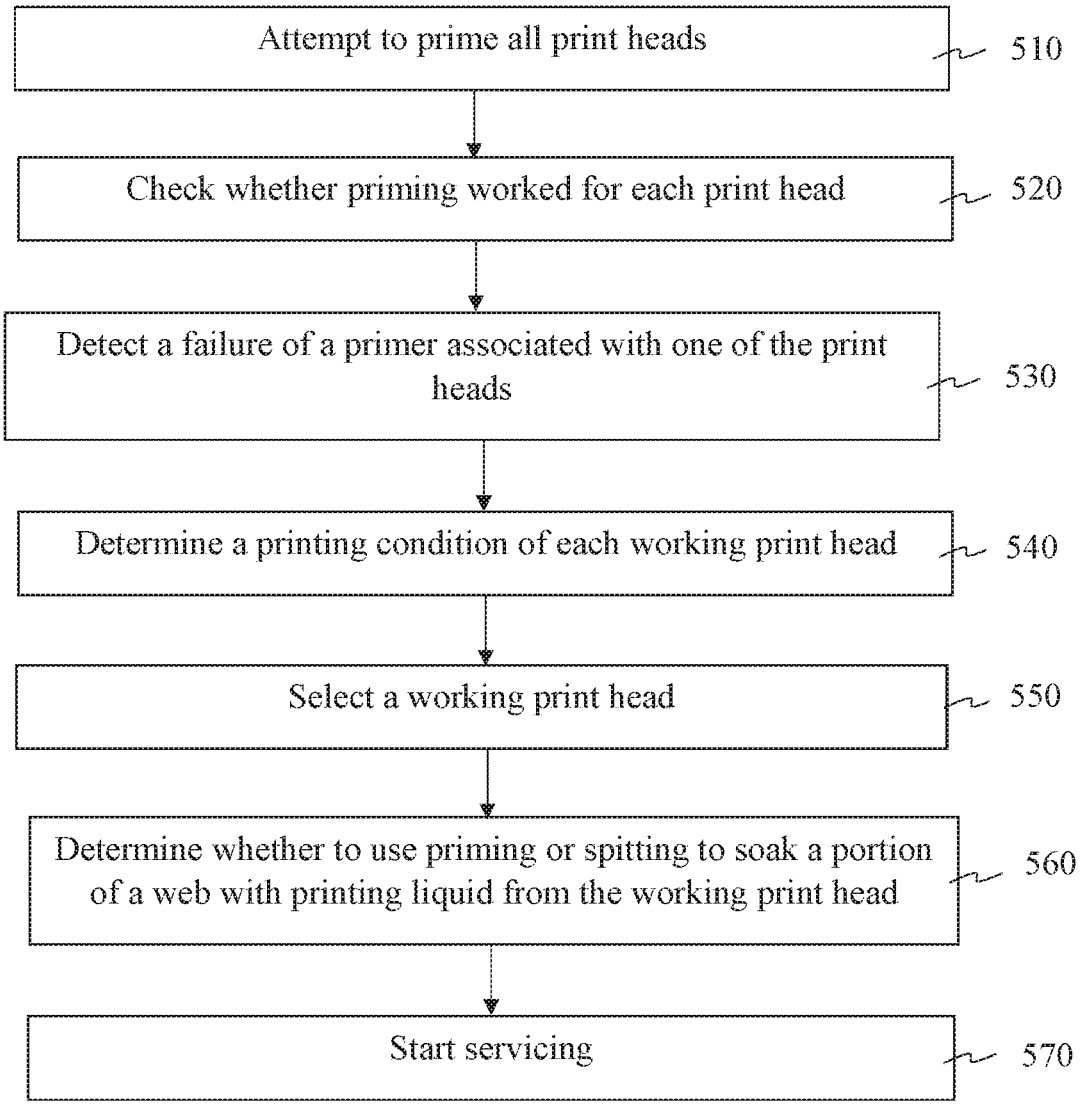
FIG. 5 is an example flowchart of a method for determining how to service a print head.

FIG. 5 is an example flowchart of a method preceding the method for servicing a print head with printing liquid soaked web. Even though the method of FIG. 5 determines the dogging condition of a nozzle by a priming operation, this is merely an example as any operation, for example, spitting, acoustic sensing, visual inspection or the like may also be used to determine a dogging condition of a nozzle. The controller first attempts to prime all print heads at 510. As mentioned above, during priming, printing liquid is forced out of the nozzles by increasing the pressure in the printing liquid chamber in the print head. The pressure is increased by using a pump to inflate a variable volume air chamber within the printing liquid chamber to expand the variable volume air chamber, move the lever 320 and open the valve at the printing liquid inlet 330. Printing liquid from the printing liquid inlet 330 enters the printing liquid chamber 215 and leaves the printing liquid chamber via the nozzles 112. The controller 130 checks whether priming has worked for each print head at 520, and if priming has not worked for a print head, the controller detects a failure of a primer arrangement associated with the print head at 530. The controller also determines the printing condition of each working print head, for which priming was successful, at 540. It determines the printing condition of the working print head at 540 to determine how well the print head is working in order to select which print head can be used to service the failed print head at 550. In some examples, the priming and detection of failures and/or determination of printing conditions may be carried out for each print head in sequence. In other examples, the priming and analysis of the printing conditions of some or all print heads may occur in parallel.

Figure 3B:
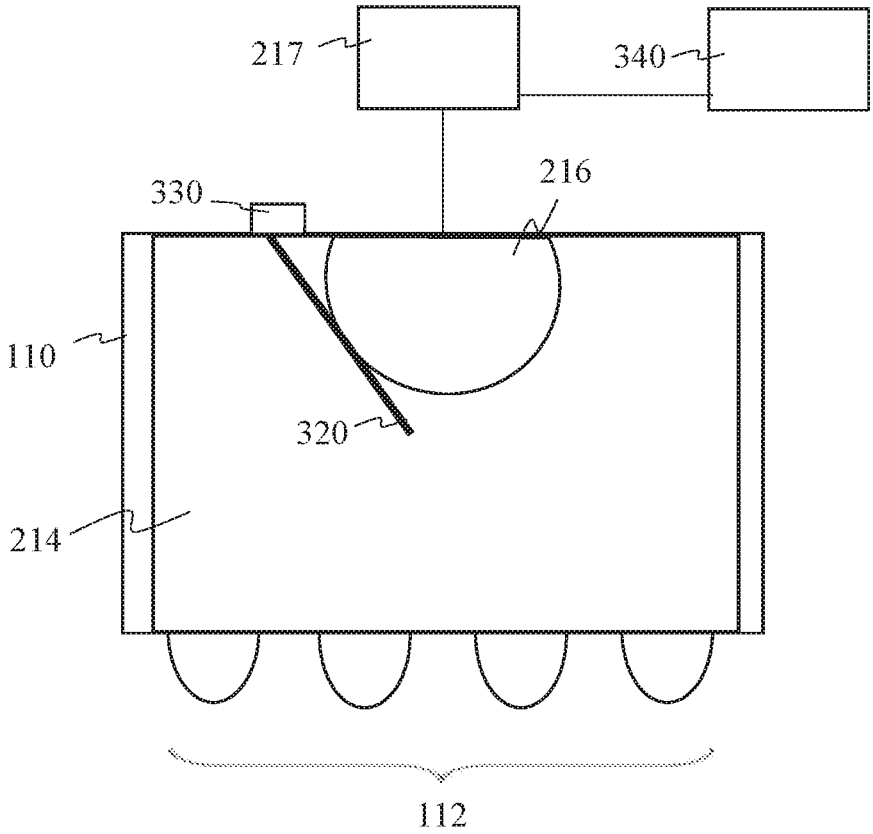

In some examples, a failure or success of a print head is determined using the pump 217 used to inflate the variable volume air chamber, the prime processing circuitry 218 and the current monitor 340 described with respect to FIGS. 3*a* and 3*b*. The pump increases the pressure in the print head and the current monitor monitors a current consumption of the pump. The processing circuitry determines a rate of change of current consumption of the pump and compares the rate of change of current consumption to a predetermined primer condition threshold. If the rate of change of current consumption is less than the predetermined threshold, then the priming is determined to have failed for that print head, and so the print head is a failed print head. If the rate of change of current consumption is at or greater than the predetermined threshold, then the priming is determined to have worked for that print head, and so the print head is a working print head. In an alternative example, the processing circuitry may determine an average current consumption. If the average current consumption falls within a predetermined range defined by primer condition thresholds, then the priming is determined to have been successful and the print head is deemed to be a working print head. If instead the average current consumption falls outside of the predetermined range, then the priming is determined to have failed and the print head is deemed to be a failed print head.

If the prime is determined to have worked, the controller may determine the printing condition of the print head using the drop detector 240. The drop detector detects whether printing liquid has been ejected from individual nozzles of the print head to determine whether any of the individual nozzles remain clogged. The controller may use the results of the drop detector to determine the printing condition of the working print head. The controller then selects a working print head to service the failed print head at 550. The controller may select the working print head based on the location of the working print head and the determined printing condition. With reference to FIG. 3*a*, if the carriage is arranged to move back and forth along guide rails and one of the print heads on the carriage fails, the controller may select any working print head on the carriage which it can position over a suitable region of the web, accessible later by the failed print head, as the first print head to soak the web with printing liquid. If there are more than one working print head, the controller may select the working print head that has the most number of working nozzles. Alternatively, it may select any print head with a printing condition that meets a specific printing condition threshold. If more than one carriage is used, and there are constraints on where the print heads can be moved by the carriages, the controller may select a print head with a satisfactory printing condition from the carriage which is most appropriate for positioning one of its print heads over a suitable region of the web. In some printing devices, the web may be moved in order to allow the failed print head to be moved to the soaked region of the web.

The controller 130 may determine the printing condition of a working print head at 550, not merely to select a suitable print head for servicing but also to decide how to carry out the servicing. The controller 130 uses the determined printing condition to determine whether to use spitting or priming to soak a portion of a web 220 with printing liquid from the working print head at 560. For example, if the nozzles of the working print head are relatively clear, the controller may determine that the working print head will use spitting to soak the region of the web. If instead a large percentage of the nozzles are partly or fully clogged, the controller may determine that the working print head will use priming to soak the web. As a specific example, the printing condition may be determined as a numeric value, such as a value from 1 to 5. Continuing with that example, if the printing condition is equal to or higher than a certain printing condition threshold, such as 3, spitting will be used. Conversely, if the printing condition is lower than the threshold, priming is used. However, the printing condition does not have to be determined as a numeric value and the selection of spitting or priming can be carried out in any suitable way. The servicing of the failed print head then commences at 570. If a prime has failed, it may be a mechanical or electrical fault in the primer arrangement. Consequently, new parts may be needed. However, by servicing the failed printing device using the method described herein, including soaking the nozzles with printing liquid, the printing device can continue to be operational until the new parts can be fitted, thereby reducing downtime of the printing device and improving system reliability.

Figure 6:
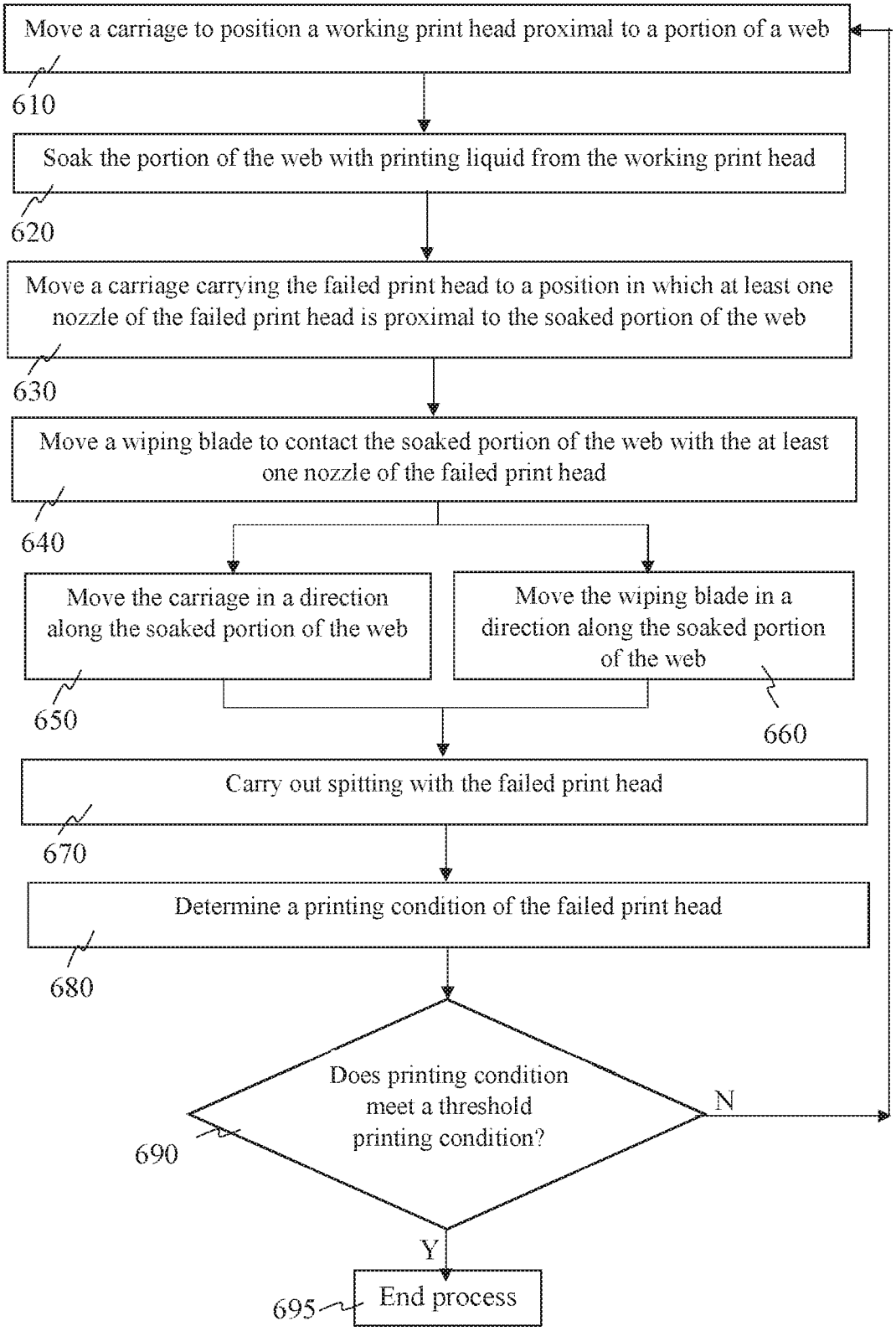
FIG. 6 provides another example flowchart of an operating method for servicing a print head.

FIG. 6 is a more detailed example of a method for servicing a failed print head, for example due to nozzle clogging. The controller 130 controls a carriage 210 carrying a working print head, to move the carriage so that the working print head is moved to be in a position in which at least one nozzle of the working print head is proximal to a portion of a web at 610. The working print head is positioned in contact with or near to the portion of the web such that priming or spitting with the working print head can soak the portion of the web. In some examples, the first working print head is positioned above the web. The portion of the web 220 is soaked with printing liquid from the working print head at 620. In more detail, the working print head may prime or spit, depending on the conclusions of the analysis described with respect to FIG. 5, the printing liquid from the nozzles of the print head to soak the portion of the web.

The controller 130 controls a carriage 210 carrying the failed print head to move at least one nozzle of the failed print head proximal to the soaked portion of the web at 630. The at least one nozzle of the failed print head is therefore in a position whereby the at least one nozzle is in contact with, or near to the soaked portion of the web 220 such that the at least one nozzle is ready to contact with, the soaked portion of the web 220. The carriage carrying the working print head may be the same carriage as the carriage carrying the failed print head. If both the working and the failed print head are supported on the same carriage, moving the failed print head into the servicing position will also remove the working print head from the web. Alternatively, if the print heads are supported by different carriages, the controller may first control the carriage supporting the working print head to remove the working print head from the servicing position before it moves the failed print head into position.

The controller 130 then engages the wiping blade. In more detail, the controller 130 moves a wiping blade 230 to contact the at least one nozzle of the failed print head with the soaked portion of the web at 640. Then, the carriage containing the failed print head is moved in a direction along the soaked portion of the web at 650, or the wiping blade 230 is moved along the soaked portion of the web 220 at 660. In either case, a plurality of the nozzles of the failed print head are wiped, by for example rubbing or gently massaging with the soaked portion of the web 220, to dynamically push printing liquid from the working print head into the nozzles of the failed print head in order to unclog the nozzles of the failed print head.

The failed print head then carries out spitting at 670 with the failed print head to clear the nozzles of the failed print head. Since the nozzles have first been soaked such that the nozzle chambers are moistened, spitting may now provide a better result and clear any remaining clogged particles from the nozzle chambers. The controller then determines a printing condition of the failed print head at 680 and determines whether the printing condition meets a threshold printing condition at 690, in order to determine whether the nozzles of the failed print have been successfully cleaned. In some examples, the drop detector may be used to determine whether the nozzles of the failed print head have been successfully cleaned. The drop detector detects whether printing liquid has been ejected from individual nozzles of the print head to determine whether any of the individual nozzles remain clogged. The controller may use the results of the drop detector to determine the printing condition of the failed print head. If it is determined that the printing condition does not meet the threshold printing condition, then the nozzles of the failed print head are deemed to be too clogged and the servicing process recommences from 610 and the soaking and spitting is repeated. However, if the printing condition does meet the threshold printing condition then the failed print head is deemed to be in working order and the servicing process ends at 695. By using spitting and repeating servicing operations if the printing condition does not meet a threshold, the chances of cleaning the nozzles are increased. However, in some examples, the servicing method may not include spitting. The method may proceed directly to determining a printing condition. In some examples, the method may not include determining a printing condition and repeating some servicing operations. The method described is just one example and variations are possible. For example, if instead the print heads are in fixed positions and the printing device instead comprises a carriage for carrying the servicing station, instead of moving a carriage carrying the failed print head at 630, the method may comprise moving a carriage carrying the servicing station to a position in which the at least one nozzle of the second print head is proximal to the soaked portion of the web. Thus, the carriage may move the wiping blade and the soaked portion of the web towards the print heads, rather than the print heads being moved towards the wiping blade and the soaked portion of the web. The wiping blade, which for example may be supported on a separate carriage, may then be moved relative to the web and the print head to wipe the nozzles at 660. Alternatively, the whole carriage carrying the servicing station may be moved, instead of moving the print heads, in order to move the soaked portion of the web and wipe the nozzles on the web. Whether a carriage is provided to move the print head or the servicing station, the carriage may first be used to draw together the second print head and the soaked portion of the web. Furthermore, wiping the nozzles may comprise moving that carriage to provide relative movement between the nozzles and the soaked portion of the web while the nozzles and the soaked portion of the web are in contact with each other.

Figure 7:
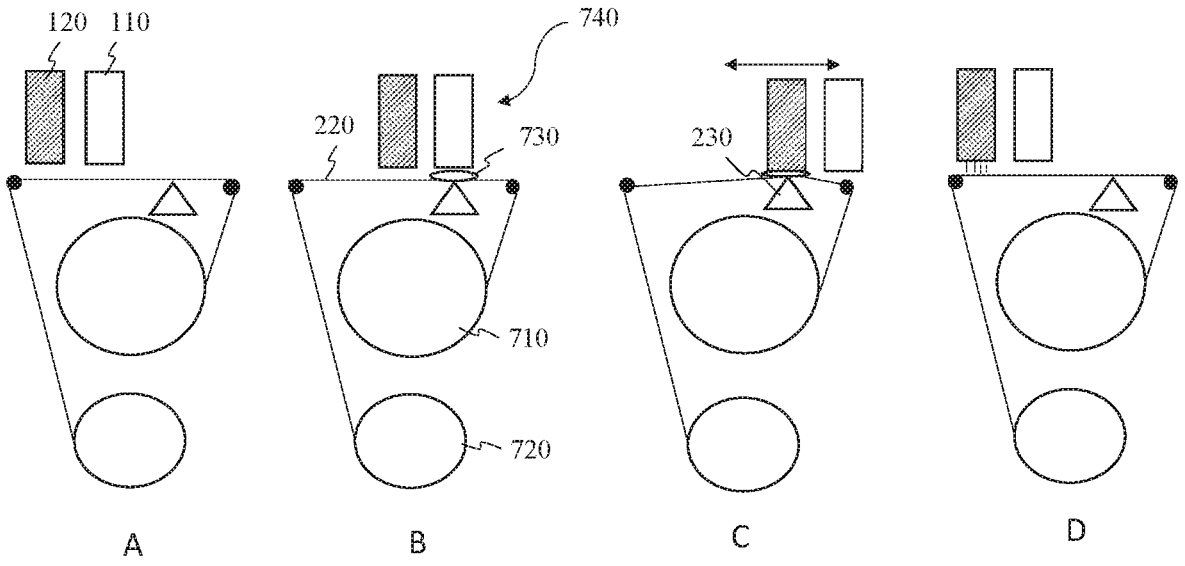
FIG. 7 is a diagrammatic illustration of an example of an operating method for servicing a print head.

FIG. 7 is a pictorial representation of an example of a method of servicing a print head. It also illustrates how the web, print heads and wiping blade can be arranged in some examples. In stage A, the controller detects a failure of a primer of a print head. The controller attempts to prime all print heads and detects that priming with a first print head 110, which contains a first set of nozzles, has worked, and so the first print head 110 is a working print head. However, the controller determines that priming with a second print head 120, which contains a second set of nozzles has failed, and so the second print head 120 is a failed print head.

In stage B, the web 220 is soaked with printing liquid from the first print head 110. The web 220 originates from an unused web wheel 710 and moves to a used web wheel 720. The controller 130 positions the first print head 110 with respect to the web 220, in a servicing position 740, so that the first print head 110 can wet a region 730 of the web with printing liquid from the first print head 110. As mentioned with respect to FIG. 5, the first print head 110 can use either priming or spitting to wet the region 730 of the web 220. The controller determines a printing condition of the first print head 110. The printing condition of the first print head 110 can be determined by using a drop detector. The controller 130 selects either priming or spitting for wetting the region of the web with printing liquid from the first print head 110 in dependence on the printing condition of the first print head 110. The controller 130 then controls the first print head 110 to wet the region 730 of the web accordingly.

In stage C, the nozzle plate of the second print head comprising the second set of nozzles 120 is wiped with the wetted region 730 of the web 220. The controller 130 positions the second print head 120 with respect to the web 220, in the servicing position, so as to wet the second set of nozzles with the wetted region 730 of the web. A wiping blade 230 is positioned on the opposite side of the wetted region 730 of the web to the print head servicing position, and therefore the second print head 120 when it is located in the servicing position. In some examples, as shown in FIG. 7, the blade may be positioned under the web. The controller 130 controls the wiping blade 230 to engage the wiping blade 230 with the wetted region 730 of the web and push the wetted region 730 of the web against the nozzles of the second print head 120. The carriage 210 carrying the second print head 120 is moved in a direction along the wetted region 730 of the web, as shown by the arrow in FIG. 7, to wipe or slowly massage the second set of nozzles of the second print head 120 along the wetted region of the web. Alternatively, or additionally, the wiping blade 230 is moved in a direction along the wetted region 730 of the web to ensure the wetted region of the web touches each of the second set of nozzles. In either case, printing liquid ejected from the first set of nozzles from the first print head 110 is pushed into the second set of nozzles of the second print head 120, to try to unclog any clogged nozzles of the second print head 120.

In stage D, spitting is performed by the second print head 120 to remove the printing liquid of the first print head 110 and any previously clogged liquid from the nozzles of the second print head 120. The controller 130 may then determine a printing condition of the second print head 120. The controller may for example use a drop detector to determine the printing condition. If the printing condition of the second print head does not meet a predetermined printing condition threshold value, then the controller may control the components of the servicing apparatus 100 to perform the operations of stages B, C and D again. However, if the printing condition of the second print head 120 does meet the predetermined threshold value, then the servicing process of the second print head will end. Although it has been described that a failure of a primer associated with a print head is detected before the servicing using printing liquid described with respect to FIGS. 4 to 7 is carried out, the wiping of the nozzles with a printing liquid soaked portion of the web could be used instead of priming. In some devices, both priming and servicing using a web soaked in printing liquid may be available as alternatives to provide redundancy, improved nozzle recoverability and a robust response to failure.

Figure 8:
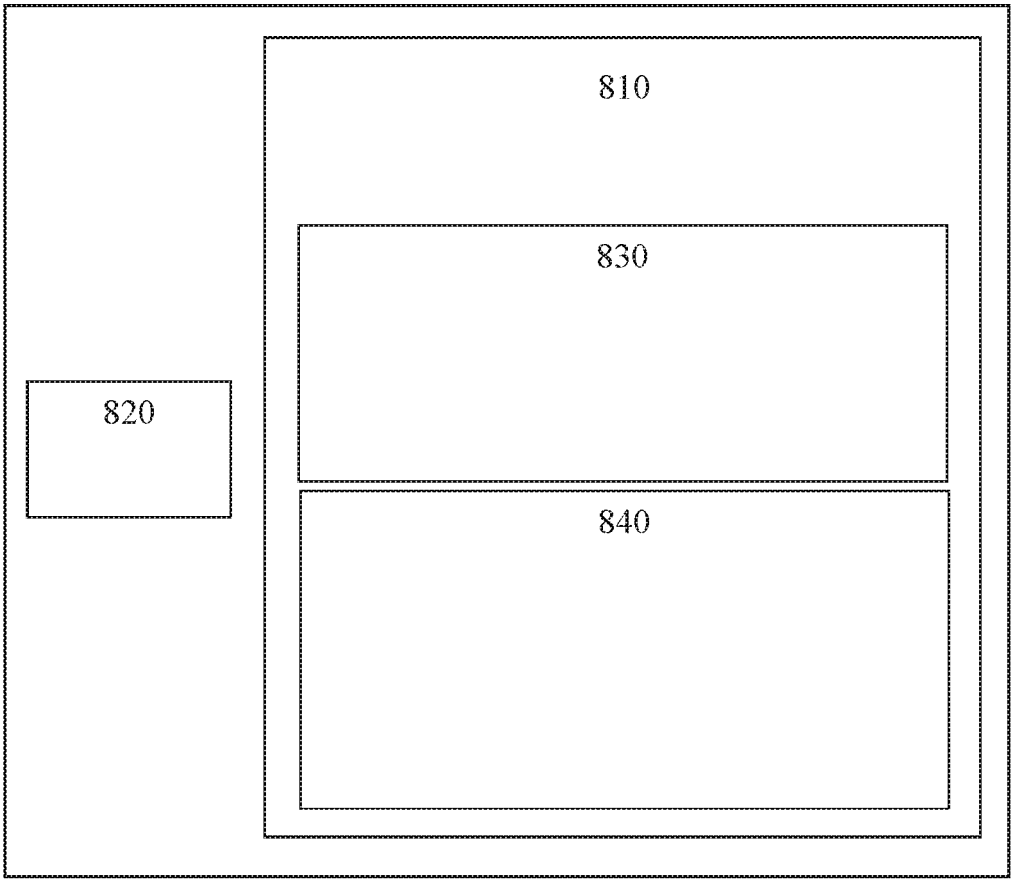
FIGS. 8 and 9 are example schematic diagrams illustrating the elements of a storage medium accessible by a processor.

FIG. 8 illustrates a non-transitory machine-readable storage medium 810 accessible by a processor 820 to carry out a method in a printing device described herein according to an example. The processor may form part of the controller 130 described above with respect to, for example, FIGS. 1 and 2. At least a part of the non-transitory machine-readable storage medium may form at least a part of the memory 250 described above with respect to, for example, FIG. 2. The non-transitory machine readable storage medium 810 is encoded with instructions that are executable by the processor 820. The instructions comprise instructions 830 to control at least one nozzle of a first print head in a printing device to soak a portion of a web with printing liquid. The instructions also comprise instructions 840 to position a second print head in the printing device with respect to the web such that at least one nozzle of the second print head is soaked by the soaked portion of the web. The storage medium may include any combination of suitable volatile memory and/or non-volatile memory, including, but not limited to, read-only memory (ROM), random access memory, cache, buffers, cloud storage etc. Although a single processor is shown, the storage medium may be shared among various processors or dedicated to particular processors. The storage medium may also comprise additional instructions and data for carrying out the method described.

Figure 9:
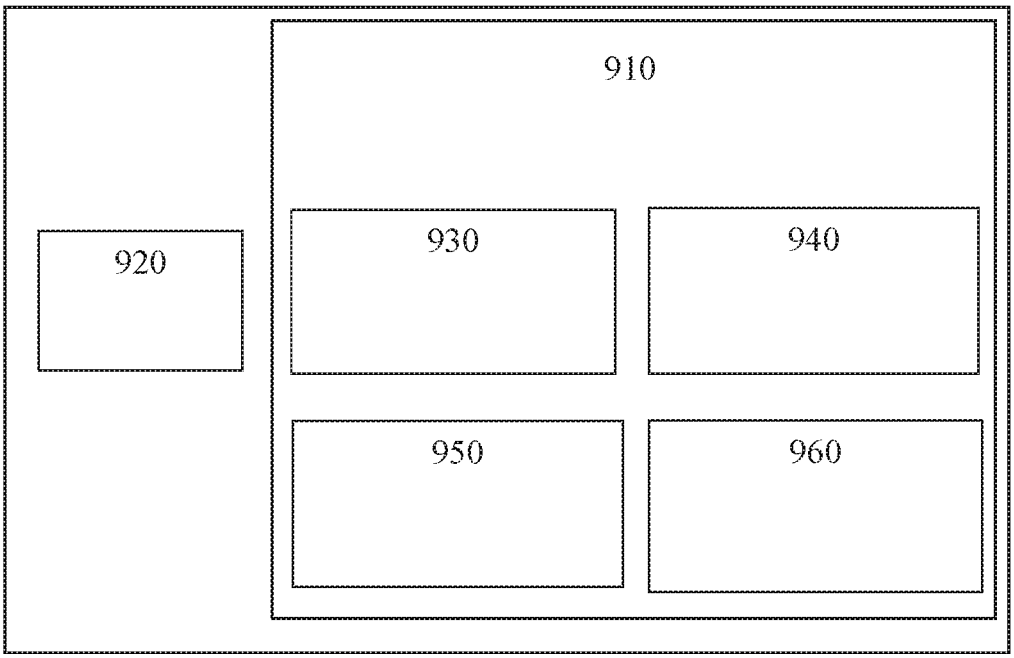

FIG. 9 shows another example of a non-transitory machine readable storage medium 910, accessible by a processor 920 for implementing the methods described above, comprising additional data and instructions. The processor 920 may be the same or different to the processor of FIG. 8 and may form part of the controller 130 described above with respect to, for example, FIGS. 1 and 2. Non-transitory machine readable storage medium 910 is encoded with machine readable instructions 930 that are executable by the processor 920. The storage medium 910 may comprise the storage medium 810 of FIG. 8 but, in addition to instructions corresponding to the instructions 830 and 840, described with respect to FIG. 8, the non-transitory machine readable storage medium 810 may also comprise additional instructions. The storage medium may, for example, store diagnostics software for determining the diagnostics of the print heads, such as whether a prime failed or succeeded and/or the printing condition of a print head. Moreover, it may comprise operating software for operating the carriage and/or the wiping blade. In more detail, it may comprise instructions for controlling the carriage transporting the first print head to position the first print head over the web for the first print head to soak the web. It may also comprise instructions for controlling the same or a different carriage transporting the second print head to move the second print head to a position in which at least one nozzle of the second print head is proximal to the soaked portion of the web. It may also comprise instructions to move the carriage carrying the second print head in a direction along the soaked portion of the web such that the at least one nozzle of the second print head is wiped along the soaked portion of the web. Additionally, or alternatively, it may comprise instructions to control a carriage on which the wiping blade is mounted to move the wiping blade, in a direction along the soaked portion of the web, such that the wiping blade moves the soaked portion of the web into contact with the at least one nozzle of the second print head. Moving the carriage or wiping blade in a direction along the soaked portion of the web may comprise moving along or across the web or in any direction along a plane parallel or substantially parallel to the web. Moreover, the storage medium may comprise instructions to detect a failure of a primer associated with the second print head and carry out the soaking of the at least one nozzle with the soaked portion of the web in response to the detection. The storage medium may further comprise instructions to determine a printing condition of the first print head, determine whether to use priming or spitting to soak the portion of the web with printing liquid from the first print head in dependence on the determined printing condition and then control the first print head to carry out the priming or spitting accordingly. The storage medium may further comprise instructions to control the second print head to carry out spitting, after the nozzles of the second print head have been wiped, to further clear the nozzles. The storage medium may further comprise instructions to determine a printing condition of the second print head and control the first and second print heads to repeat the soaking and spitting if the determined printing condition does not meet a threshold printing condition.

The non-transitory machine readable storage medium 810 may further comprise a storage area for storing data used by the processor to carry out the servicing method. For example, it may store at least one primer condition threshold 940 to be used to determine if a prime has succeeded or failed as described herein. It may also store at least one printing condition threshold 950. The printing condition thresholds can be used, as described herein, to determine which print head to be used to soak the web, what method to use to soak the web with a working print head and/or whether further servicing of a print head shall be carried out. Different or the same thresholds may be used for the different processes as appropriate. The storage medium may also store the determined printing conditions 960 of the print heads determined during services. Additionally, the storage medium may store additional data used during the primer diagnostics, such as the determined average current consumption or rate of change of the current consumption. It may also store ID numbers for the determined failed and working print heads so that specific print heads can be identified and controlled. The processor 920 would then access this stored information to determine how to control the components of the printing device.

Some of the data described with respect to FIGS. 8 and 9 may be stored in an internal processor memory and some may be stored in an external memory such as a cloud storage server. The storage medium may not store all the instructions and data described above and it may also store additional instructions and data.

The description of the various aspects and examples of the present disclosure has been presented for purposes of illustration and description, but is not intended to be exhaustive or to limit the disclosure to the forms disclosed. Any example of a feature or alternative described herein may be combined with any other example of a feature and alternative described, as appropriate, and the disclosure includes the various combinations and configurations of examples and alternatives.

For example, although specific methods and components have been described to determine a printing condition of a print head, such as a drop detector, other methods and components can be used. Moreover, although a specific method for determining the primer condition of the print head has been disclosed, other methods and components can be used.

Furthermore, although soaking of the web has been described as separate to the initial prime, if priming of the print heads has been carried out, a soaked region of the web resulting from the earlier priming can be used to soak the nozzles. Consequently, the controller may not control the working print head to carry out further priming or spitting.

Furthermore, although the carriage transporting the print heads have been described to be guided on rails, any suitable mechanism for transporting the print heads can be used. If carriages are used, they do not have to be guided on rails but another arrangement could be used. Moreover, carriages, or another mechanism for transporting the print heads, that can move the print heads in one or more directions in a plane parallel to the web or even in and out of that plane can be used. The carriage and/or blade may slowly be moved in one direction or slowly be moved back and forth to allow the nozzles to be soaked and cleared. Moreover, although the carriage and print heads have been shown in the drawings to be located above the web and the blade to be located below the web, the locations of the web and the blade depend on the orientation of the print heads. If the print heads are not facing down but in another direction, other locations and arrangements for soaking and wiping the nozzles can be used. Moreover, instead of, or in addition to, moving the carriage and/or the blade to wipe the nozzles, in some devices, the web may be moved to wipe the nozzles. In some examples, instead of, or in addition to a carriage for moving the print heads, the servicing components may be provided on a carriage or other mechanism for transporting the servicing station to the print heads. If the wiping of the nozzles includes moving the soaked portion of the web relative to the nozzles while they are in contact with each other, the web may be moved for example by moving the carriage or other mechanism for transporting the servicing station and/or by operating web wheels such as the web wheels described with respect to FIG. 7.

Moreover, although a nozzle cleaning method including soaking nozzles with printing liquid has been described to be carried out in response to a prime failing, the servicing method can be used even if the system does not include a primer arrangement, before a prime is attempted or as an alternative to priming. In some devices, primer arrangements may not be available and the method of cleaning nozzles by soaking the nozzles with printing liquid described herein can be used instead of priming. In those cases, spitting would be used to soak the web.

The invention claimed is:

1. A method comprising:

soaking a portion of a web in a printing device with printing liquid from a first print head of the printing device; and wiping at least one nozzle of a second print head in the printing device with the soaked portion of the web.

2. A method of claim 1, further comprising moving a carriage to a position in which the at least one nozzle of the second print head is proximal to the soaked portion of the web.

3. A method of claim 1, wherein wiping the at least one nozzle comprises moving a carriage to provide relative movement between the at least one nozzle and the soaked portion of the web while in contact with each other.

4. A method of claim 1, wherein wiping the at least one nozzle comprises moving a wiping blade, in a direction along the soaked portion of the web, such that the wiping blade moves the soaked portion of the web into contact with the at least one nozzle of the second print head.

5. A method of claim 1, further comprising detecting a failure of a primer associated with the second print head before wiping the at least one nozzle of the second print head with the soaked portion of the web.

6. A method of claim 1, further comprising determining a printing condition of the first print head; and determining whether to use priming or spitting to soak the portion of the web with printing liquid from the first print head in dependence on the determined printing condition of the first print head.

7. A method of claim 1, further comprising, subsequent to wiping the at least one nozzle of the second print head:

carrying out spitting with the second print head;

determining a printing condition of the second print head; and repeating the soaking and spitting if the determined printing condition does not meet a threshold printing condition.

8. Apparatus for a printing device comprising:

a first print head comprising a first set of nozzles;

a second print head comprising a second set of nozzles; and a controller to wet a region of a web in printing liquid using the first set of nozzles and to subsequently position the second print head with respect to the web so as to wet the second set of nozzles with the wetted region of the web.

9. The apparatus of claim 8, further comprising a carriage to carry the second print head, the controller further to control the carriage to move the second print head to a position in which the second set of nozzles are near or in contact with the wetted region of the web.

10. The apparatus of claim 9, wherein the carriage is movable in a direction along the wetted region of the web to wipe the second set of nozzles along the wetted region of the web.

11. The apparatus of claim 9, further comprising a wiping blade movable in a direction along the wetted region of the web to ensure the wetted region of the web touches each of the second set of nozzles.

12. The apparatus of claim 8, wherein the controller is to attempt to prime the second print head and control the first print head to wet the region of the web with printing liquid from the first print head in response to determining that the prime of the second print head failed.

13. The apparatus of claim 8, wherein the controller is to determine a printing condition of the first print head;

select priming or spitting for wetting the region of the web with printing liquid from the first print head in dependence on the printing condition of the first print head; and control the first print head to wet the region accordingly.

14. A printing device comprising an apparatus of claim 8.

15. A non-transitory machine-readable storage medium encoded with instructions executable by a processor, the machine-readable storage medium comprising:

instructions to control at least one nozzle of a first print head in a printing device to soak a portion of a web with printing liquid; and instructions to position a second print head in the printing device with respect to the web such that at least one nozzle of the second print head is soaked by the soaked portion of the web.

* * * * *